US007753726B2

(12) United States Patent
Malstrom et al.

(10) Patent No.: US 7,753,726 B2
(45) Date of Patent: Jul. 13, 2010

(54) COMPOSITE ELECTRICAL CONNECTOR ASSEMBLY

(75) Inventors: Charles Randall Malstrom, Lebanon, PA (US); James Robert Bennawit, Lancaster, PA (US); Dieter Uwe Bozzer, Pura (CH); Patrick Duquerroy, Seligenstadt (DE); Alessio Mariotti, Vernate (CH)

(73) Assignees: Tyco Electronics Corporation, Berwyn, PA (US); Tyco Electronics AMP GmbH, Bensheim (DE); Tyco Electronics Logistics AG, Steinach (SG) (CH)

( * ) Notice: Subject to any disclaimer, the term of this patent is extended or adjusted under 35 U.S.C. 154(b) by 97 days.

(21) Appl. No.: 12/103,956

(22) Filed: Apr. 16, 2008

(65) Prior Publication Data

US 2009/0264017 A1 Oct. 22, 2009

(51) Int. Cl.
*H01R 9/05* (2006.01)

(52) U.S. Cl. ..... 439/581

(58) Field of Classification Search ..... 439/578–585
See application file for complete search history.

(56) References Cited

U.S. PATENT DOCUMENTS 4,746,305 A * 5/1988 Nomura ..... 439/319
5,046,952 A 9/1991 Cohen et al.
5,439,394 A 8/1995 Ikeda
5,823,824 A 10/1998 Mitamura et al.
6,860,761 B2 * 3/2005 Lee et al. ..... 439/582
7,347,727 B2 * 3/2008 Wlos et al. ..... 439/578
2001/0053629 A1 * 12/2001 Togashi et al. ..... 439/578
2004/0161969 A1 * 8/2004 Wlos et al. ..... 439/578
2008/0261446 A1 10/2008 Arnaud et al.

FOREIGN PATENT DOCUMENTS

EP 1126561 8/2001

OTHER PUBLICATIONS

European Search Report, EP Application No. EP 09 15 8083, International Filing Date Apr. 16, 2009.
Radiall; Announcements: A composite 7/16 has hatched; single piece design; www.radiall.com; 2 pgs.
Composite Square Flange Jack Receiptacle Panel Seal and Waterproof Interface Rear Mounting M3 Screw; 2 pgs.
A 7-16 Composite Flange Receptacle; Cables & Connectors Supplement; Microwave Journal; Mar. 2008; pp. 36-37.

* cited by examiner

*Primary Examiner*—Ross N Gushi

(57) ABSTRACT

A composite electrical connector assembly includes a housing, a shield, and an electrical contact. The housing is formed from a first material and has an interior chamber. The interior chamber includes a stepped cylindrical surface with first and second openings at mating and mounting ends of the housing, respectively. The interior chamber is staged in diameter to form front, intermediate and rear stages. The shield is formed from a second material and is shaped to fit within the interior chamber. The shield engages the rear stage of the interior chamber and is prevented from being removed from the second opening by the rear stage. The electrical contact is disposed within the interior chamber, is aligned along a longitudinal axis of the connector assembly and is configured to receive a center conductor of a cable and to connect with a conductor of a communication device.

20 Claims, 13 Drawing Sheets

500

COMPOSITE ELECTRICAL CONNECTOR ASSEMBLY

BACKGROUND OF THE INVENTION

The subject matter herein generally relates to electrical connectors and, more particularly, to ah electrical connector having a housing component and a shield component.

Various electrical connectors are formed of a single body machined from metal stock. For example, many RF connectors are screw machined from a single piece of metal stock. The metal stock used for many electrical connectors includes copper and copper alloys such as brass. The relatively high cost of these types of metals can represent a significant portion of the overall cost in manufacturing an electrical connector.

When the cost of the metal stock increases, the cost of fabricating the electrical connectors also increases. For example, the value of the waste metal resulting from machining a threaded connection on an electrical connector can exceed the cost of machining the threaded connection. Yet, the metal stock used in current electrical connectors provides strong structural support for the connection between the electrical connector and the plug end of a cable, while also shielding the electrical connector from electromagnetic interference.

A need exists to lower the cost involved in fabricating electrical connectors, while maintaining a strong structural support for the electrical connector and shielding the electrical connector from electromagnetic interference.

BRIEF DESCRIPTION OF THE INVENTION

In one embodiment, a composite electrical connector assembly includes a housing, a shield, and an electrical contact. The housing is formed from a first material and has an interior chamber. The interior chamber includes a stepped cylindrical surface with a first opening at a mating end of the housing and a second opening at a mounting end of the housing. The interior chamber is staged in diameter to form front, intermediate and rear stages. The shield is formed from a second material and is shaped to fit within the interior chamber. The shield engages the rear stage of the interior chamber and is prevented from being removed from the second opening by the rear stage. The electrical contact is disposed within the interior chamber and is aligned along a longitudinal axis of the connector assembly. The electrical contact has first and second ends. The first end is configured to receive a center conductor of a cable. The second end is configured to connect with a conductor of a communication device.

In another embodiment, an electrical connector assembly includes a housing, a shield and an electrical contact. The housing has an interior chamber that includes an inner surface. The inner surface has first and second openings at opposing ends of the housing. The interior chamber is staged in diameter to form front, intermediate and rear stages. The shield is shaped to fit within the interior chamber. The shield engages at least one of the intermediate and rear stages of the interior chamber to prevent the shield from being removed from the first opening. The electrical contact is disposed within the interior chamber and is aligned along a longitudinal axis of the connector assembly. The electrical contact has first and second ends. The first end is configured to receive a center conductor of a cable. The second end is configured to connect with a conductor of a communication device.

In another embodiment another composite electrical connector assembly includes a housing, a shield, an electrical contact and a dielectric holder. The housing is formed from a first material and includes a mating end, a mounting end, and an interior chamber. The interior chamber includes an inner surface with a first opening at the mating end and a second opening at the mounting end. The interior chamber also has a plurality of inside diameters. The shield is formed from a second material and is shaped to fit within the interior chamber. The shield has an outside surface that engages the inner surface of the housing. At least a portion of the outside surface has an outside diameter that is larger than at least one of the inside diameters of the interior chamber. The electrical contact is disposed within the interior chamber and is configured to receive a center conductor of a cable. The dielectric holder is disposed between the electric contact and the shield. The dielectric holder electrically isolates the electrical contact from the shield.

DETAILED DESCRIPTION OF THE INVENTION

Figure 1:
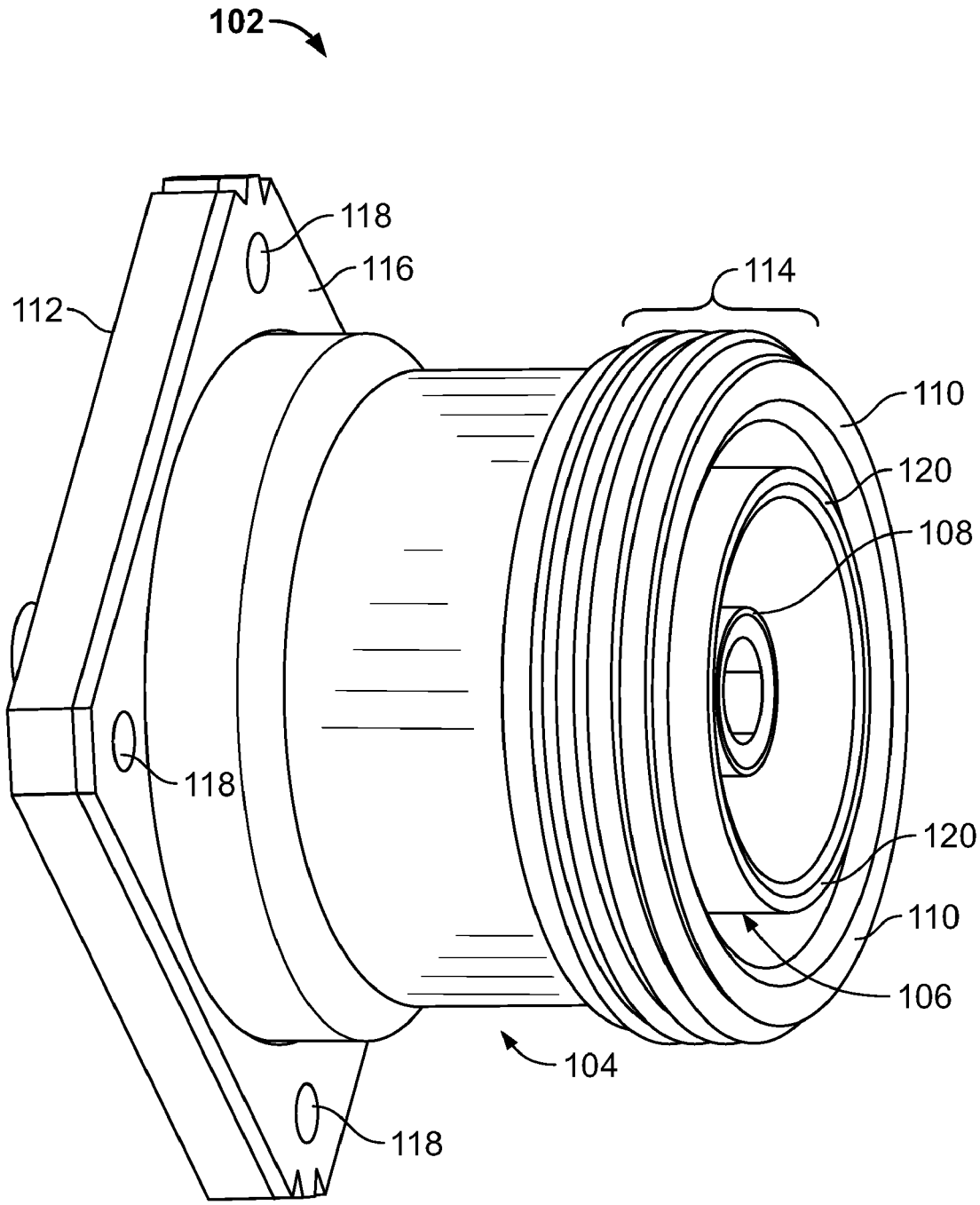
FIG. 1 is a top perspective view of a composite electrical connector assembly formed according to one embodiment.

FIG. 1 is a top perspective view of a composite electrical connector assembly 102 formed according to one embodiment. The connector assembly 102 includes a shield 106 located within a cylindrical shaped housing 104. An electrical contact 108 is located within the shield 106. In one embodiment, the connector assembly 102 is an RF connector.

In one example embodiment, the connector assembly 102 separates the existing mechanical and electrical requirements of an RF connector. For example, the housing 104 may meet one or more of the mechanical requirements of an RF connector. The mechanical requirements may include providing a load bearing component that mechanically couples with a cable and/or a device panel. The mechanical requirements also may include providing protection to the connector assembly 102 from environmental conditions. The shield 106 may meet one or more of the electrical requirements of an RF connector. The electrical requirements may include shielding signals communicated through the connector assembly 102 from electromagnetic interference.

In an exemplary embodiment, the housing 104 provides structural support for the connector assembly 102, while the shield 106 shields electrical signals from electromagnetic interference. Additionally, the shield 106 and the housing 104 are formed of different materials or have outside surfaces that are coated with different materials. For example, the shield 106 may be formed from a conductive material, while the housing 104 is formed from a nonconductive or dielectric material.

In one embodiment, the shield 106 is formed of or an outside surface of the shield 106 is coated with copper or an alloy containing copper. Other conductive metals, however, can be used in alternative embodiments. The shield 106 may be formed using a variety of processes, including a screw machining process.

The housing 104 is formed from a nonconductive material. For example, the housing 104 may be formed from a plastic material such as a thermoplastic material. In another example, the housing 104 may comprise a plastic material. For example, the housing 104 may comprise polysulfone ("PES"), polybutylene terephthalate ("PBT") or 30% glass filled PBT. In another embodiment the housing 104 may comprise polyphenylene sulfide ("PPS"). The housing 104 may be created using an injection molding process or other forming processes. In alternative embodiments, the housing 104 may be formed from, or have an outside surface that is coated with a conductive material. For example, the housing 104 may be formed from a metal or metal alloy, and may be a die cast metal. The housing 104 may be formed from a non-ferrous metal such as zinc, copper or aluminum based alloy. Alternatively, the housing 104 may be formed from a magnesium alloy. For example, the housing 104 may be created using a thixomolding™ forming process.

The shield 106 is separately fabricated from, and received within, the housing 104. The shield 106 is provided along at least a portion of the interior of the housing 104. As an example, the shield 106 may be less than 1 mm thick and disposed within the housing 104. Alternatively, the shield 106 may be between 0.9 and 1 mm thick, but other smaller and larger thicknesses are possible in alternative embodiments.

By forming the housing 104 and the shield 106 from different materials, the cost of manufacturing the connector assembly 102 can be reduced. For example, the shield 106 may be formed of copper or a copper alloy while the housing 104 is formed of a less expensive material. The housing 104 has a tubular elongated shape that extends between a mating end 110 and a mounting end 112. The housing 104 includes a male threaded connection 114 that is located proximate to the mating end 110. The housing 104 also includes a plurality of mounting holes 118 that are proximate to the mounting end 112. The mounting holes 118 may be threaded holes or through holes. Screws, fasteners or other attachment devices can be inserted through the mounting holes 118 to secure the housing 104 to a device surface or panel. The shield 106 has a tubular elongated shape that extends between a connector interface end 120 and a terminating end 122 (shown in FIG. 2).

Additionally, in one embodiment, a nut plate 116 is separately provided proximate to the mounting end 112. The mounting holes 118 in the mounting end 112 may extend through the nut plate 116. The nut plate 116 may be placed in engagement with the housing 104 to protect the housing 104 from the screws or other attachment devices that are inserted through the mounting holes 118.

Figure 2:
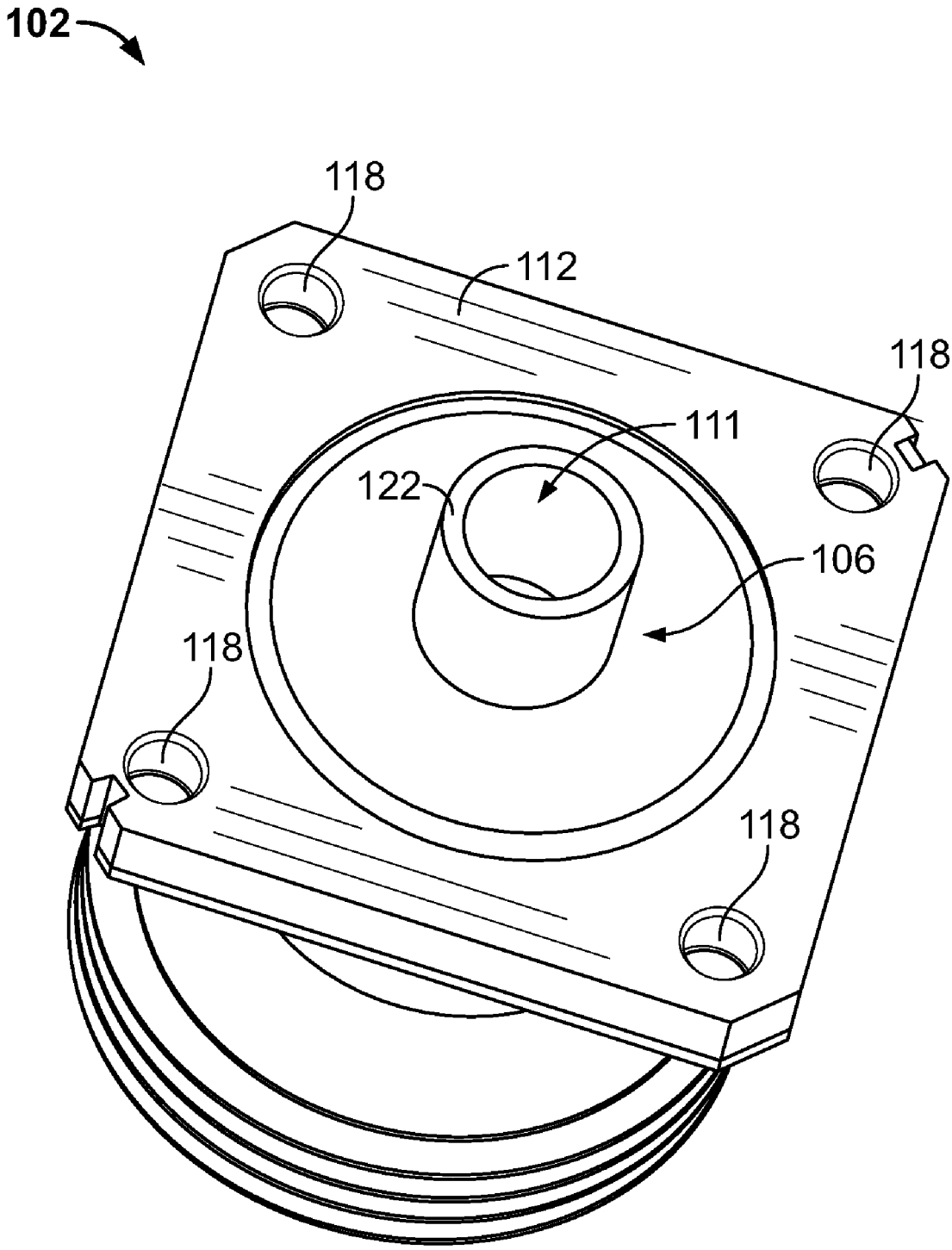
FIG. 2 is a bottom perspective view of the connector assembly of FIG. 1.

FIG. 2 is a bottom perspective view of the connector assembly 102 of FIG. 1. As shown in FIG. 2, the terminating end 122 of the shield 106 is proximate to the mounting end 112. The terminating end 122 extends beyond the mounting end 112. The terminating end 122 includes a cylindrical boss having a bore 111 through the center of the boss. The terminating end 122 may include a male or female threaded connection (not shown).

Figure 3:
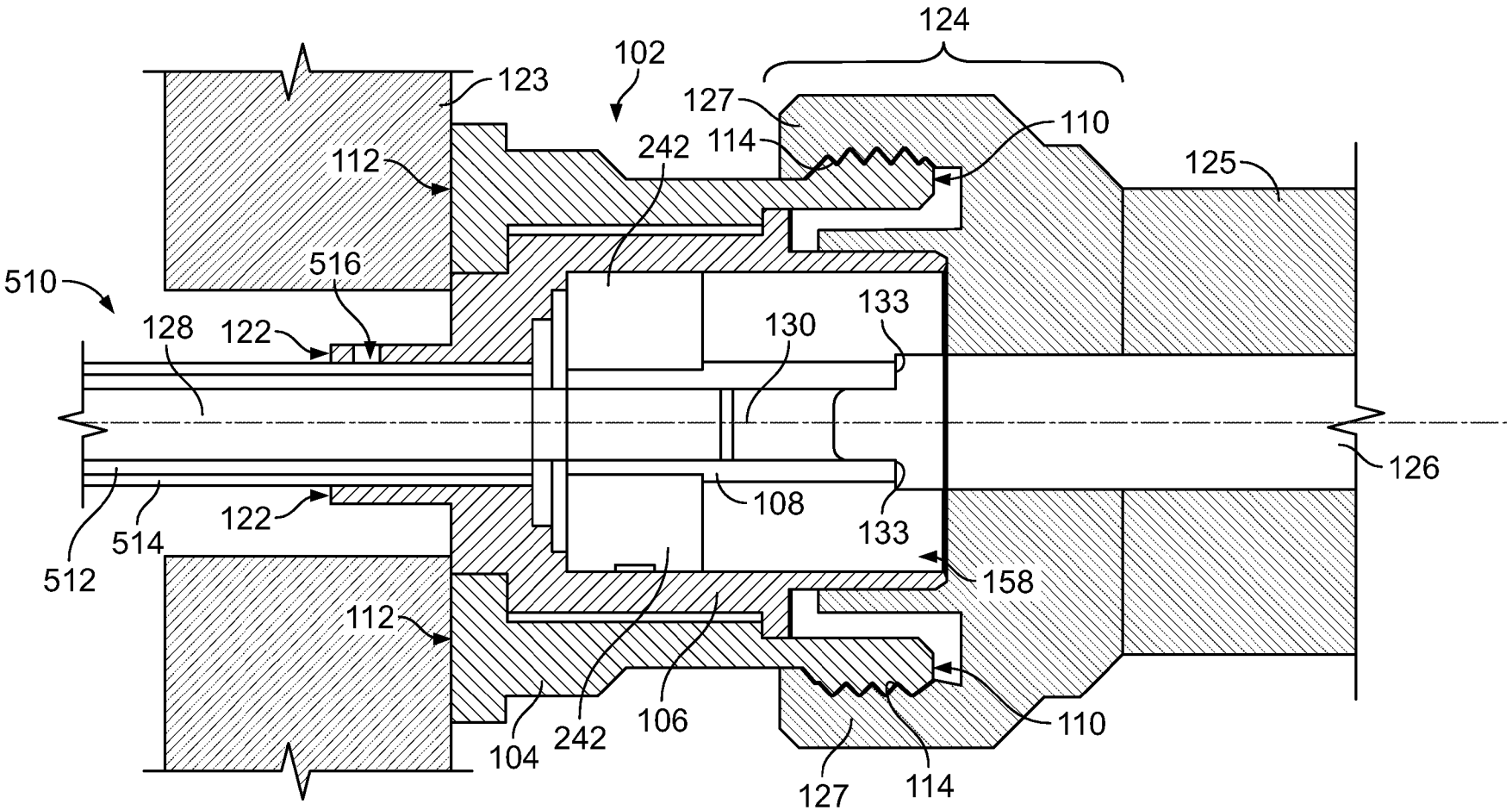
FIG. 3 is a cross-sectional view of the connector assembly mounted on a device panel in accordance with one embodiment.

FIG. 3 is a cross-sectional view of the connector assembly 102 mounted on a device panel 123. A cable 125 is connected to the connector assembly 102. The cable 125 includes a plug end 124 that engages with the mating end 110 of the housing 104. The plug end 124 may include a nut configured to engage the threaded connection 114. The plug end 124 may comprise a metal such as a copper alloy. In another embodiment, the plug end 124 may comprise the same or similar material as the housing 104. Alternatively, the plug end 124 may comprise a nonconductive material such as a plastic.

The cable 125 may include an electrical conductor 126 capable of communicating a signal. The mounting end 112 is configured to be mounted on the device panel 123. The electrical conductor 126 is inserted into the housing 104 through the mating end 110 and into the shield 106 through the connector interface end 133. The device panel 123 may represent a panel of a radio or other communication device. The terminating end 122 of the shield 106 protrudes into the device panel 123 and is grounded to the panel 123.

As shown in FIG. 3, the electrical contact 108 is held within the housing 104. The electrical contact 108 is aligned substantially centered along a longitudinal axis 130 of the connector assembly 102. The electrical contact 108 includes opposing ends 133 and 135. The first end 133 of the electrical contact 108 includes an opening for receiving one end of the electrical conductor 126 of the cable 125 to establish an electric connection. For example, the first end 133 of the electrical contact 108 may include an opening that receives a center conductor of a coaxial cable. The second end 135 of the electrical contact 108 receives a semi-rigid cable 510 that is held within the device panel 123. Alternatively, the cable 510 is not held within the device panel 123. In the illustrated embodiment, the cable 510 includes a center contact cable 128 surrounded by a dielectric cable 512, which is surrounded by an outer contact cable 514. The center contact cable 128 may be a wire or a contact of the communication device. The center contact cable 128 extends through the device panel 123 and through the terminating end 122 of the shield 106 to terminate to the electrical contact 108, such as by soldering or other known termination techniques.

In the illustrated embodiment, the electrical connector 108 is positioned within, and electrically isolated from, the shield 106. For example, a dielectric holder 242 supports the electrical contact 108 within a cavity 158 of the shield 106. The dielectric holder 242 may be a ring of a dielectric or insulating material with an open center that receives the in the electrical contact 108.

The housing mating end 110 mates with the plug end 124 of the cable 125. The cable 125 may be a coaxial cable. In an exemplary embodiment, the plug end 124 of the cable 125 includes a female threaded connection 127 that mates with the threaded connection 114 of the housing 104. The center conductor 126 of the cable 125 extends through the cable 125 and the plug end 124 of the cable 125. When the plug end 124 of the cable 125 mates with the housing mating end 110, the center conductor 126 of the cable 125 engages the electrical contact 108 located in the shield 106.

A conductive pathway between the cable 125 and the center contact cable 128 in the device panel 123 is established via the connector assembly 102 once the plug end 124 of the cable 125 is mated with the mating end 110 of the housing 104.

The shield 106 may be held inside the housing 104 through a press fit or friction fit connection between the shield 106 and the housing 104. Alternatively, the shield 106 and housing 104 may be held together using an adhesive. In another embodiment, the shield 106 is held in the housing 104 by over molding.

In an alternative embodiment, a cable (not shown) is connected to the terminating end 122 of the shield 106 instead of mounting the connector assembly 102 to the panel 123. For example, a shielded cable having the center contact cable 128 may connect to the terminating end 122 and the center contact cable 128 may terminate to the electrical contact 108.

A hole 516 may be provided in the shield 106 in a location that is proximate to the terminating end 122. The hole 516 may help facilitate soldering of the center contact cable 128 to the shield 106, for example. Alternatively, the hole 123 is not provided in the shield 106.

Figure 4:
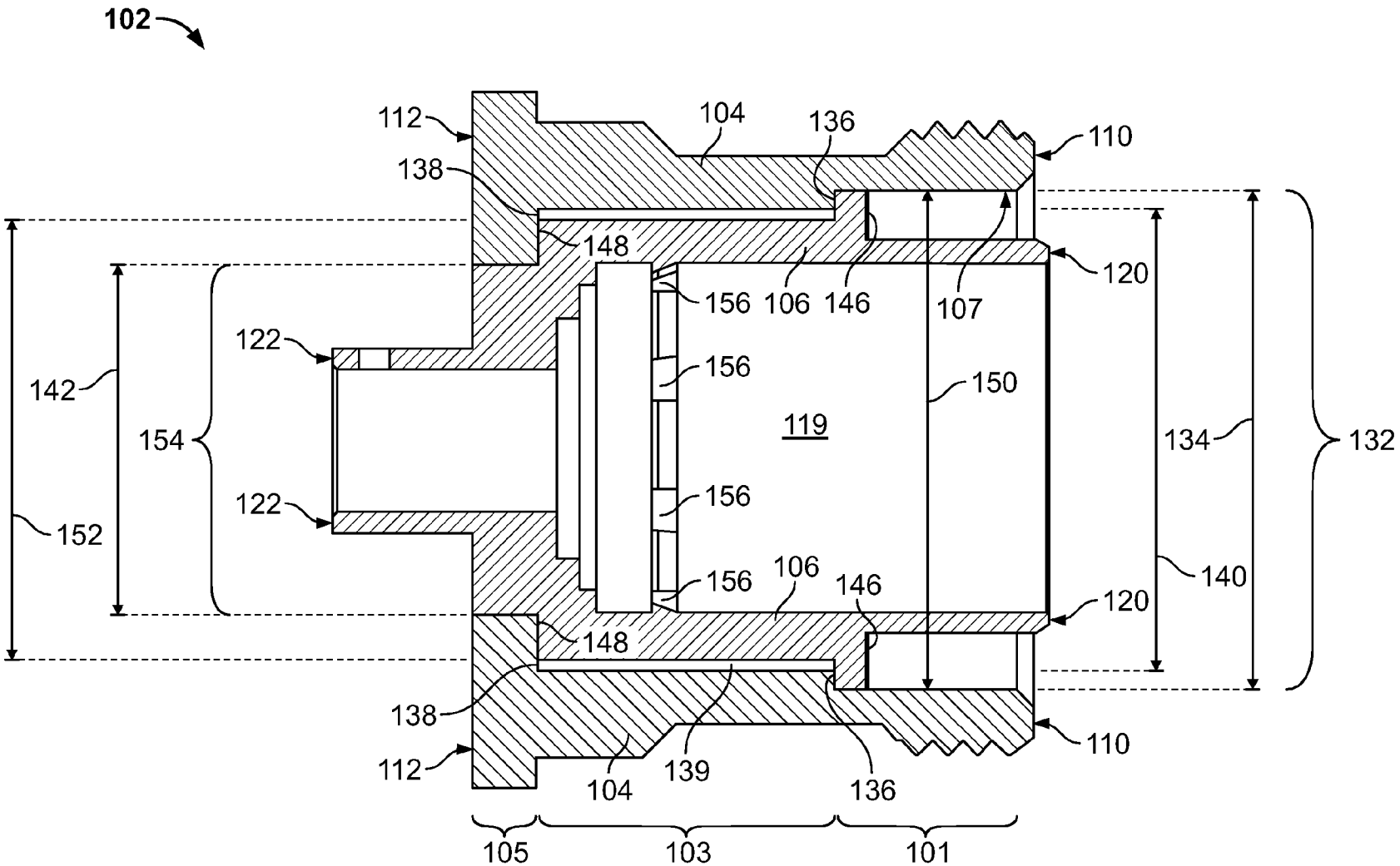
FIG. 4 is a cross-sectional view of the connector assembly of FIG. 1.

FIG. 4 is a cross-sectional view of the connector assembly 102. The housing 104 includes an interior opening 119 having a first opening 132 at the mating end 110 and a second opening 154 at the mounting end 112. The interior opening 119 has a stepped cylindrical inner surface 107 that is staged in diameter to form front, intermediate and rear stages 101, 103 and 105. The front and intermediate stages 101 and 103 are separated by a first shoulder 136. The intermediate and rear stages 103 and 105 are separated by a second shoulder 138.

The interior opening 119 has a different inside diameter in each of the front, intermediate and rear stages 101, 103 and 105. The interior opening 119 has an inside diameter 134 in the front stage 101, an inside diameter 140 in the intermediate stage 103 and an inside diameter 142 in the rear stage 105. The inside diameter 134 of the front stage 101 is greater than the inside diameter 140 of the intermediate stage 103 and the inside diameter 142 of the rear stage 105. The inside diameter 140 of the intermediate stage 103 is greater than the inside diameter 142 of the rear stage 105.

The shield 106 has an outer surface 139 that is shaped to fit within the interior opening 119. The outer surface 139 includes a flange 146 located proximate to the connector interface end 120. The flange 146 radially projects outward from the outer surface 139 to an outside diameter 150. The outside diameter 150 of the flange 146 is greater than the inside diameter 140 of the intermediate stage 103 of the housing 104. In one embodiment, the outside diameter 150 of the flange 146 is approximately equal to the inside diameter 134 of the front stage 101 of the housing 104.

The outer surface 139 of the shield 106 also includes a shoulder 148. The shoulder 148 is located between the intermediate and rear sections 103 and 105 of the housing 104. The outer surface 139 has an outside diameter 152 between the shoulder 148 and the flange 146. The outer surface 139 of the shield 106 at the shoulder 148 engages with the shoulder 138 of the housing 105.

In one embodiment, the shield 106 also includes a plurality of contours 156 between the terminating end 122 and the connector interface end 120. The contours 156 include indentations or tabs that extend radially inward from the shield 106. The contours 156 impede the separation of the dielectric holder 242 that is inserted into the interior of the shield 106 from the shield 106.

During assembly, the shield 106 is inserted into the interior opening 119 of the housing 104 through the first opening 132. The shield 106 is inserted into the interior opening 119 of the housing 104 until the flange 146 of the shield 106 engages the first shoulder 136 of the housing 104 and/or until the shoulder 148 of the shield 106 engages the second shoulder 138 of the housing 104.

The first shoulder 136 of the housing 104 engages the flange 146 of the shield 106 and prevents the flange 146 from being inserted into the interior opening 119 of the housing 104 past the first shoulder 136. Similarly, the second shoulder 138 of the housing 104 engages the shoulder 148 of the shield 106 and prevents the shoulder 148 of the shield 106 from being inserted into the interior opening 119 of the housing 104 past the second shoulder 138. Thus, the shield 106 is inserted into the interior opening 119 of the housing 104 through the first opening 132 but is prevented from exiting the housing 104 through the second opening 154 by one or both of the first and second shoulders 136 and 138 of the housing 104.

The shield 106 may be held inside the interior opening 119 of the housing 104 through a press fit or friction fit connection between the outer surface 139 of the shield 106 and the housing 104. Alternatively, the outer surface 139 of the shield 106 and housing 104 may be held together using an adhesive.

Figure 5:
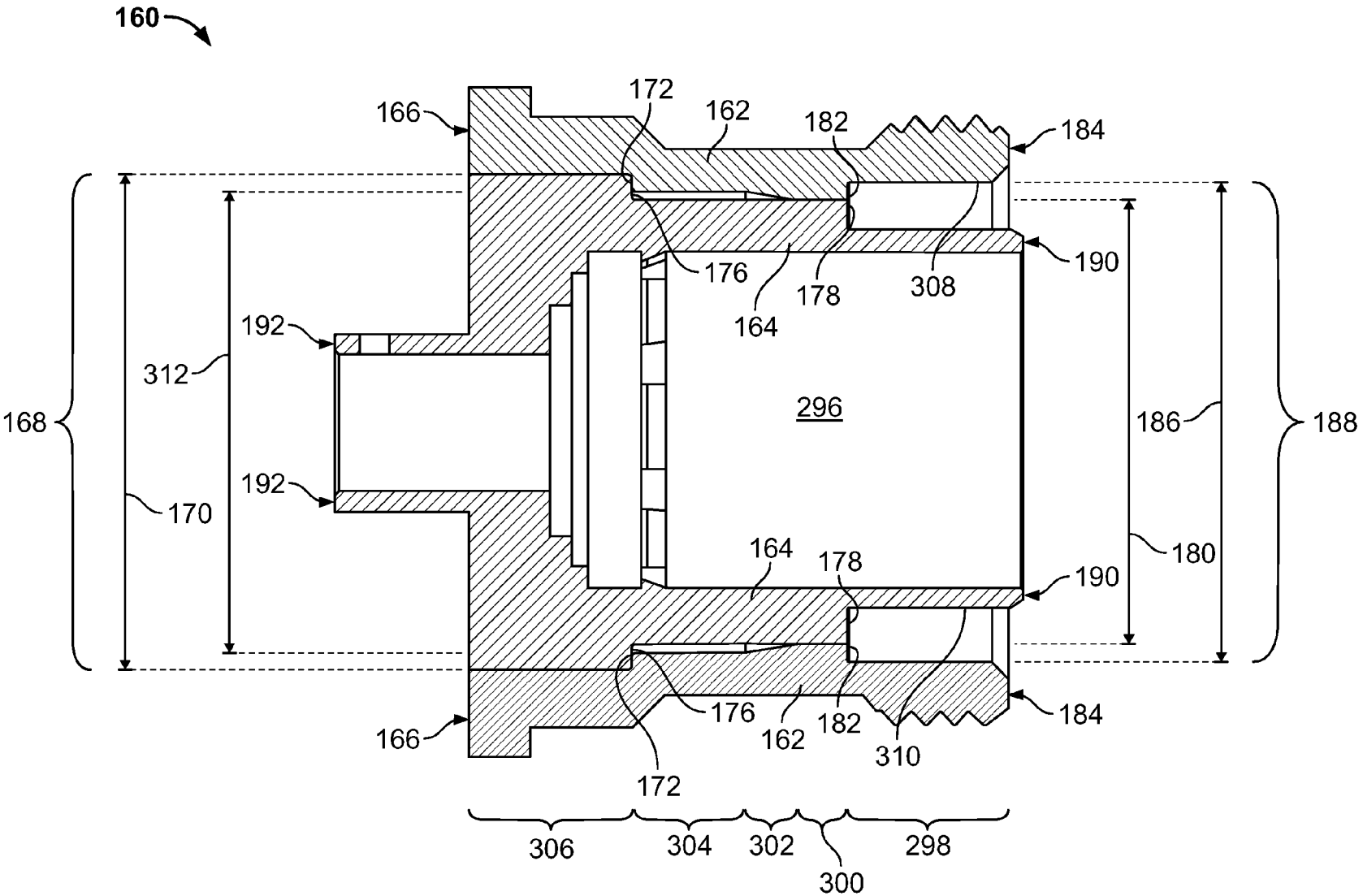
FIG. 5 is a cross-sectional view of another embodiment of a composite electrical connector assembly.

FIG. 5 is a cross-sectional view of another embodiment of a composite electrical connector assembly 160. The connector assembly 160 includes a housing 162 having an interior opening 296 with a first opening 188 at a mating end 184 and a second opening 168 at a mounting end 166. The interior opening 296 has a stepped cylindrical inner surface 308 that is staged in diameter to form a front stage 298, a rear stage 306 and an intermediate stage that includes first, second and third intermediate stages 300, 302 and 304. The front and first intermediate stages 298 and 300 are separated by a flange 182. The third intermediate and rear stages 304 and 306 are separated by a shoulder 172.

The interior opening 296 has a different inside diameter in two or more of the stages 298, 300, 302, 304 and 306. The interior opening 296 has an inside diameter 186 in the front stage 298, an inside diameter 180 in the first intermediate stage 300, an inside diameter 312 in the third intermediate stage 304, and an inside diameter 170 in the rear stage 306. The inside diameter of the second intermediate stage 302 increases from the inside diameter 180 at the location where the second intermediate stage 302 transitions from the first intermediate stage 300 to the inside diameter 312 at the location where the second intermediate stage 302 transitions from the third intermediate stage 304.

The inside diameter 186 of the front stage 298 is greater than the inside diameters 180 and 312 of the first and third intermediate stages 300 and 304. The inside diameter of the rear stage 306 is greater than the inside diameter 312 of the third intermediate stage 304.

The connector assembly 160 also includes a shield 164 disposed within the interior opening 296 of the housing 162. The shield 164 has a tubular elongated shape that extends between a connector interface end 190 and a terminating end 192. The shield 164 has an outer surface 310 that is shaped to fit within the interior opening 296.

The outer surface 310 includes a first shoulder 178. The first shoulder 178 is located between the front and first intermediate stages 298 and 300 of the interior opening 296 of the housing 162. The outer surface 310 of the shield 164 includes a portion having an outside diameter that is approximately the same as the inside diameter 180 of the first intermediate stage 300 of the interior opening 296 of the housing 162.

The outer surfaced 310 of the shield 164 also includes a second shoulder 176 located between the third intermediate and rear stages 304 and 306. The outer surface 310 of the shield 164 includes a portion having an outside diameter that is approximately the same as the inside diameter 170 of the third intermediate stage 306 of the interior opening 296 of the housing 162.

During assembly, the shield 164 is inserted into the interior opening 296 of the housing 162 through the second opening 168. The shield 164 is inserted into the interior opening 296 of the housing 162 until the second shoulder 176 of the shield 164 engages the shoulder 172 of the housing 162. The shoulder 172 of the housing 162 engages the second shoulder 176 of the shield 164 and prevents the second shoulder 176 from being inserted into the interior opening 296 of the housing 162 past the shoulder 172. Thus, the shield 164 is inserted into the interior opening 296 of the housing 162 through the second opening 168 but is prevented from exiting the housing 162 through the first opening 188 by the shoulder 172 of the housing 162.

Figure 6:
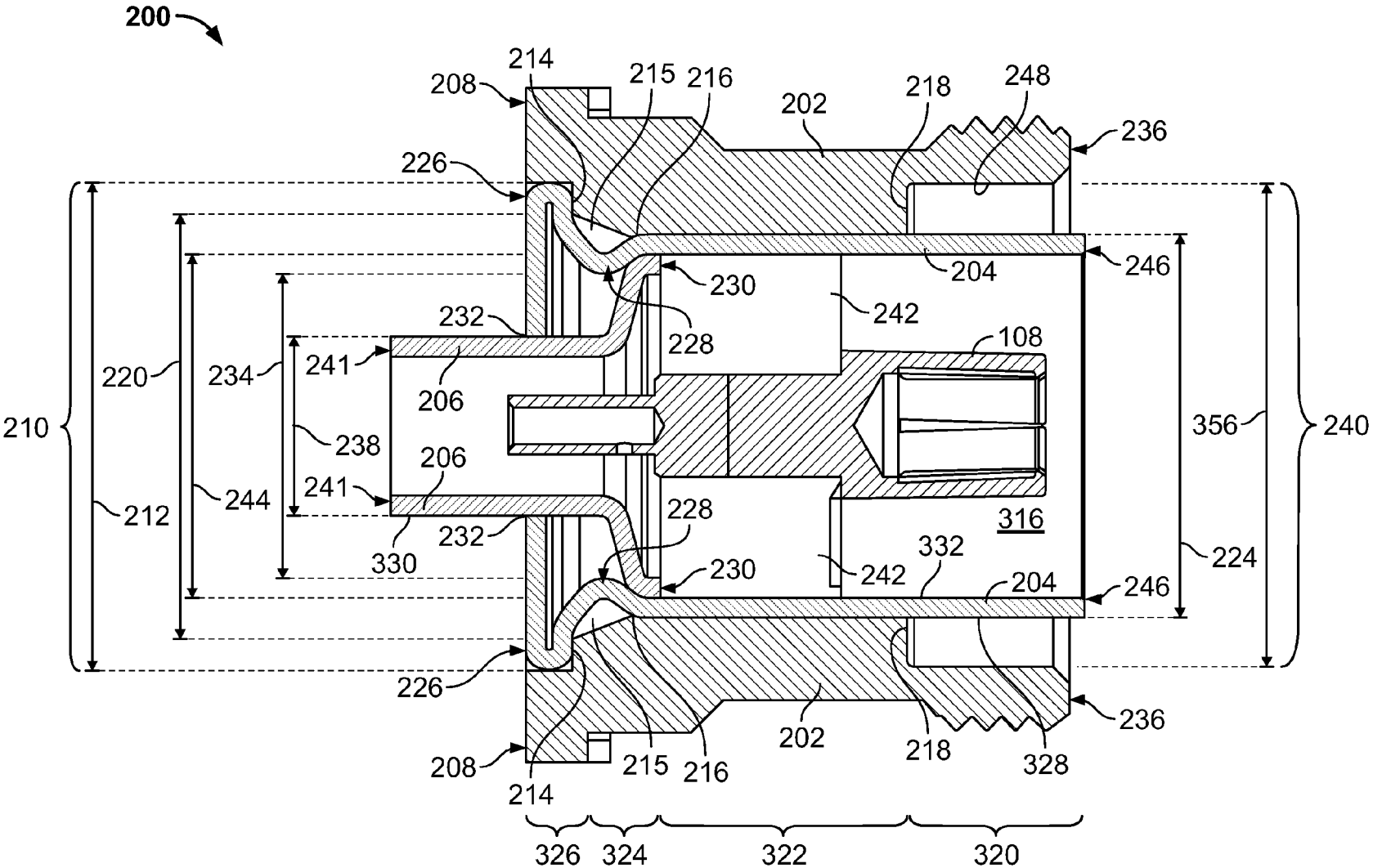
FIG. 6 is a cross-sectional view of another embodiment of a composite electrical connector assembly.

FIG. 6 is a cross-sectional view of another embodiment of a composite electrical connector assembly 200. The connector assembly 200 includes a housing 202 having an interior opening 316 with a first opening 240 at a mating end 236 and a second opening 210 at a mounting end 208. The interior opening 316 has a stepped cylindrical inner surface 248 that is staged in diameter to form a plurality of stages 320, 322, 324 and 326. The plurality of stages includes a front stage 320, an intermediate stage that includes first and second intermediate stages 322, 324, and a rear stage 326. The inner surface 248 also includes three shoulders 214, 216 and 218. The first shoulder 218 separates the front and first intermediate stages 320 and 322. The second shoulder 216 separates the first and second intermediate stages 322 and 324. The third shoulder 214 separates the second intermediate and rear stages 324 and 326.

The interior opening 316 has a different inside diameter in three or more of the stages 320, 322, 324 and 326. The interior opening 316 has an inside diameter 356 in the front stage 320, an inside diameter 224 in the first intermediate stage 322, and an inside diameter 212 in the rear stage 326. The inside diameter of the second intermediate stage 324 increases from the inside diameter 224 at a location that is proximate to the first intermediate stage 322 to an inside diameter 220 at a location that is proximate to the rear stage 326.

The inside diameters 356 and 212 of the front and rear stages 320 and 326 are greater than the inside diameter 224 of the first intermediate stage 322. Additionally, the inside diameters 356 and 212 of the front and rear stages 320 and 326 are greater than the inside diameters of the second intermediate stage 324.

The connector assembly 200 also includes a first shield 204 and a second shield 206 disposed within the interior opening 316 of the housing 202. The first shield 204 extends between a connector interface end 246 and a terminating end 232. The terminating end 232 of the first shield 204 is located proximate to the mounting end 208 of the housing 202 The terminating end 232 engages the second shield 206 in a location proximate the mounting end 208 of the housing 202.

The first shield 204 includes a plurality of bends. The bends include a first bend 226 and a second bend 228. The first and second bends 226 and 228 transition the first shield 204 from the connector interface end 246 to the inner surface 248 of the housing 202 to the second shield 206. A gap 215 may be located between the first shield 204 and the housing 202 in a location that is between the first and second bends 226, 228.

The first bend 226 is located proximate the mounting end 208 of the housing 202. In one embodiment, the first bend 226 is a bend that causes the first shield 204 to bend inwards from the inner surface 248 of the housing 202 towards the second shield 206. In an exemplary embodiment, the first bend 226 is a 180 degree bend. However, other angles in the first bend 226 are within the scope of the subject matter described herein.

The second bend 228 in the first shield portion 204 is proximate the mounting end 208 of the housing 202. The second bend 228 provides a seat for the second shield 206 to engage. In one embodiment, the first shield 204 bends in opposing directions between the first and second bends 226 and 228. For example, the first shield 204 bends towards the inner surface 248 of the housing 202 at the second bend 228 while the first shield 204 bends away from the inner surface 248 of the housing 202 and towards the second shield 206 at the first bend 226. In an exemplary embodiment, the second bend 228 is a bend of a smaller angle than the first bend 226. For example, the second bend 228 may be a 90 degree bend.

The first shield 204 has an outer surface 328 that is shaped to fit within the interior chamber 316 of the housing 202. The outer surface 328 has an outside diameter between the second shoulder 216 of the interior chamber 316 of the housing 202 and the connector interface end 246 of the first shield 204 that is approximately the same as the inside diameter 224 of the first intermediate stage 322 of the inner surface 248 of the housing 202. The outer surface 328 has an outside diameter in a location proximate to the first bend 226 in the first shield 204 that is approximately the same as the inside diameter 212 of the rear stage 326 of the inner surface 248 of the housing 202.

The first shield 204 also has an inner surface 332. The inner surface 332 has an inside diameter 234 in a location that is proximate to the second bend 228 in the first shield 204. The inside diameter 234 of the inner surface 332 is less than the inside diameters 356, 224, and 212 of the front, first intermediate and rear stages 320, 324 and 326 of the inner surface 248 of the housing 202. Moreover, the inside diameter 234 of the inner surface 332 of the first shield 204 is less than the inside diameters of the second intermediate stage 324 of the inner surface 248 of the housing 202.

The second shield 206 has an outer surface 330 that is shaped to fit within the first shield 204. Additionally, the outer surface 330 of the second shield 206 is shaped to protrude from the mounting end 208 of the housing 202 between the terminating ends 232 of the first shield 204. The second shield 206 extends between a shoulder end 230 and a terminating end 241. The shoulder end 230 of the second shield 206 is located in the interior chamber 316 of the housing 202 between the second bend 228 of the first shield 204 and the first shoulder 218 of the inner surface 248 of the housing 202.

The outer surface 330 of the second shield 206 has an outside diameter 244 at a location that is proximate to the shoulder end 230 of the second shield 206 and to the first bend 228 of the first shield 204. The outside diameter 244 is greater than the inside diameter 234 of the inner surface 332 of the first shield 204.

The outer surface 330 of the second shield 206 also has an outside diameter 238 at the terminating end 241 of the second shield 206. The outside diameter 238 is less than the inside diameter 234 of the inner surface 332 of the first shield 204.

The electrical contact 108 and the dielectric holder 242 are disposed in the interior opening 316 of the housing 202. The electrical contact 108 and dielectric holder 242 are located within the interior opening 316 so as to be substantially concentric with the housing 202 and the first shield 204. While the electrical contact 108 and the dielectric holder 242 are not shown in other Figures described herein, the electrical contact 108 and the dielectric holder 242 may be disposed within any of the embodiments of the composite electrical connector assembly. The dielectric holder 242 may comprise an electrically insulating material such as a fluorinated polymer. For example, the dielectric holder 242 may be machined from a Teflon-based material.

During assembly, the first shield 204 is inserted into the interior opening 316 of the housing 202 through the second opening 210. The first shield 204 is inserted into the interior opening 316 until the first bend 226 of the first shield 204 engages the third shoulder 214 of the housing 202.

The third shoulder 214 of the housing 202 engages the first bend 226 of the first shield 204 and prevents the first bend 226 from being inserted into the interior opening 316 of the housing 202 past the third shoulder 214. Thus, the first shield 204 is inserted into the interior opening 316 of the housing 202 through the second opening 210 but is prevented from exiting the housing 202 through the first opening 240 by the third shoulder 214 of the housing 202.

The second shield 206 is inserted into the interior opening 316 of the housing 202 through the first opening 240. The second shield 206 is inserted into the interior opening 316 and into the first shield 204 until the second bend 228 of the first shield 204 engages the shoulder end 230 of the second shield 206.

The second bend 228 of the first shield 204 engages the shoulder end 230 of the second shield 206 and prevents the shoulder end 230 from being inserted into the interior opening 316 of the housing 202 past the second bend 228. Thus, the second shield 206 is inserted into the interior opening 316 of the housing 202 through the first opening 240 but is prevented from exiting the housing 202 through the second opening 210 by the second bend 228 in the first shield 204.

In one embodiment, the second shield 206 is engaged with the first shield 204 through a press fit or friction fit connection. For example, the shoulder end 230 of the second shield 206 may be held in a press fit connection with the first shield 204 in a location proximate to the second bend 228 in the first shield 204. Additionally, the terminating end 232 of the first shield 204 may engage the second shield 206 and hold the second shield 206 in place through a press fit or friction fit connection. In another embodiment, the first and second shields 204 and 206 are engaged by placing adhesive between the first and second shields 204 and 206.

Alternatively, the second shield 206 is first inserted into the first shield 204 during assembly. The combination of the first and second shields 204 and 206 is then inserted into the interior opening 316 of the housing 202 through the second opening 210.

Figure 7:
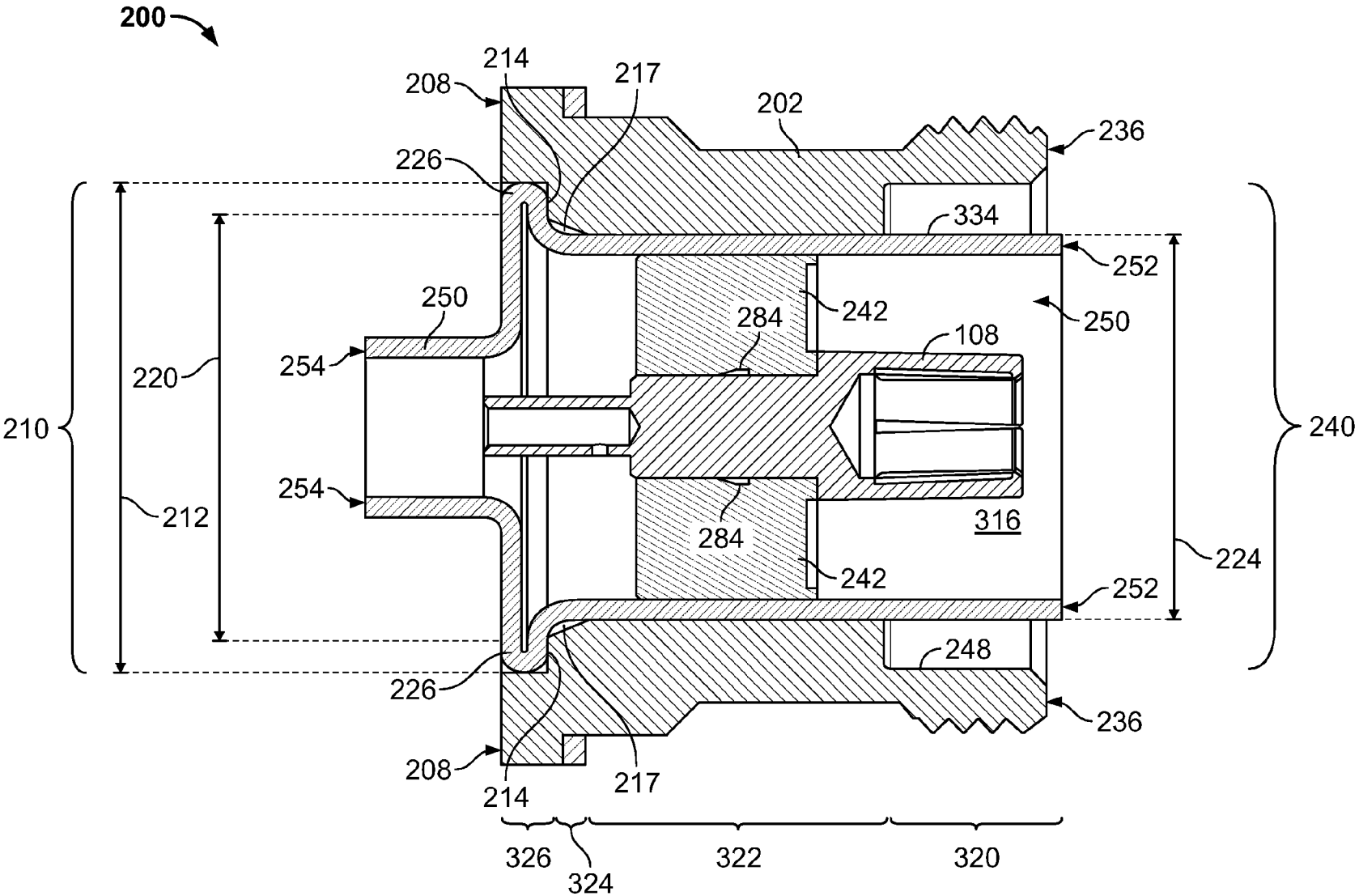
FIG. 7 is a cross-sectional view of another embodiment of the composite electrical connector assembly of FIG. 6.

FIG. 7 is a cross-sectional view of another embodiment of the composite electrical connector assembly 200 shown in FIG. 6. As shown in FIG. 7, this embodiment of the connector assembly 200 includes a single shield 250. The shield 250 has a tubular shape that extends between a connector interface end 252 and a terminating end 254. The shield 250 has an outer surface 334 that is shaped to fit within the interior chamber 316 of the housing 202. The outer surface 334 has an outside diameter between the third shoulder 214 of the interior chamber 316 of the housing 202 and the connector interface end 252 of the shield 250 that is approximately the same as the inside diameter 224 of the first intermediate stage 322 of the interior chamber 316.

The shield 250 also includes the first bend 226. The outer surface 334 of the shield 250 has an outside diameter in a location proximate to the first bend 226 that is approximately the same as the inside diameter 212 of the rear stage 326 of the inner surface 248 of the housing 202. A gap 217 may be provided between the shield 250 and the housing 202 in a location that is proximate to the first shoulder 214 of the housing 202.

The electrical contact 108 and the dielectric holder 242 are disposed in the interior opening 316 of the housing 202. In the illustrated embodiment, the electrical contact 108 includes a barb 284. The barb 284 extends radially outward from the electrical contact 108 into the dielectric holder 242. The barb 284 impedes or prevents the electrical contact 108 from being separated from the dielectric holder 242.

During assembly, the shield 250 is inserted into the interior opening 316 of the housing 202 through the second opening 210. The shield 250 is inserted into the interior opening 316 until the first bend 226 of the shield 250 engages the third shoulder 214 of the housing 202. The third shoulder 214 of the housing 202 engages the first bend 226 of the shield 250 and prevents the first bend 226 from being inserted into the interior opening 316 of the housing 202 past the third shoulder 214. Thus, the shield 250 is inserted into the interior opening 316 of the housing 202 through the second opening 210 but is prevented from exiting the housing 202 through the first opening 240 by the third shoulder 214 of the housing 202.

Figure 8:
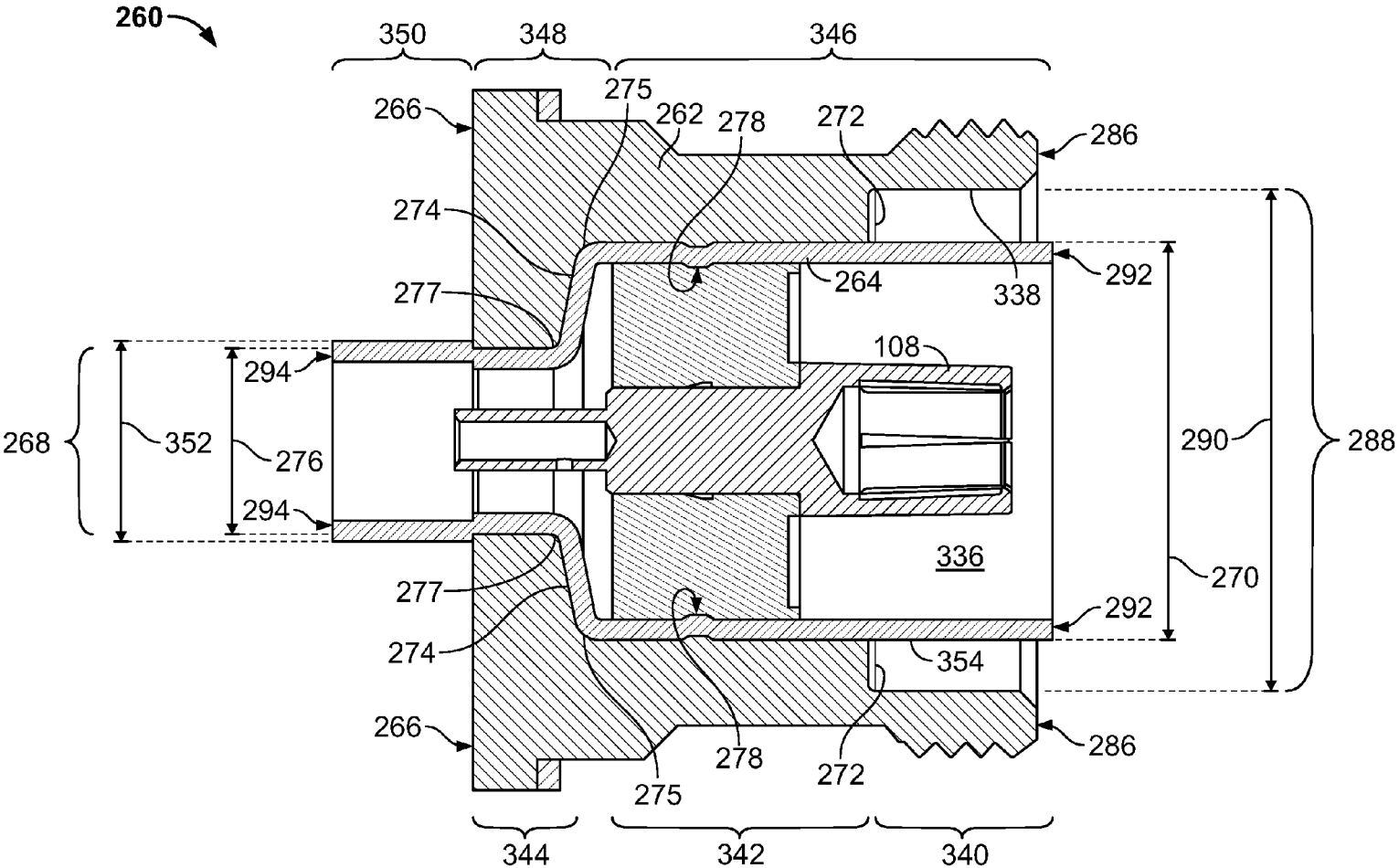
FIG. 8 is a cross-sectional view of another embodiment of a composite electrical connector assembly.

FIG. 8 is a cross-sectional view of another embodiment of a composite electrical connector assembly 260. The connector assembly 260 includes a housing 262. The housing 262 has a tubular elongated shape that extends between a mating end 286 and a mounting end 266. The housing 262 includes an interior chamber 336 having a first opening 288 at the mating end 292 and a second opening 268 at the mounting end 266. The interior chamber 336 has a stepped cylindrical inner surface 338 that is staged in diameter to form front, intermediate and rear stages 340, 342 and 344. The front and intermediate stages 340 and 342 are separated by a first shoulder 272. The intermediate and rear stages 342 and 344 are separated by a second shoulder 274.

The interior chamber 336 has different inside diameters in the front, intermediate and rear stages 340, 342 and 344. The interior chamber 336 has an inside diameter 290 in the front stage 340, an inside diameter 270 in the intermediate stage 342 and an inside diameter 276 in the rear stage 344. The inside diameter 290 is greater than the inside diameter 270 of the intermediate stage 342 and the inside diameter 276 of the rear stage 344. The inside diameter 270 of the intermediate stage 342 is greater than the inside diameter 276 of the rear stage 344.

The connector assembly 260 also includes a shield 264. The shield 264 has a tubular elongated shape that extends between a connector interface end 292 and a terminating end 294. The shield 264 is shaped to fit within the interior chamber 336. The shield 264 has a stepped cylindrical outer surface 354 that is shaped to fit within the interior chamber 336. The outer surface 354 is staged in diameter to form first, second and third stages 346, 348 and 350. The first and second stages 346 and 348 are located within the interior opening 336 of the housing 262. The third stage 350 is located outside the housing 262 in a location that is proximate to the mounting end 266 of the housing 262. A first bend 275 in the shield 264 separates the first and second stages 346, 348. A second bend 277 in the shield 264 separates the second and third stages 348, 350.

The first stage 346 of the outer surface 354 has an outside diameter that is approximately the same as the inside diameter 270 of the intermediate stage 342 of the housing 262. The second stage 348 of the outer surface 354 has an outside diameter that is approximately the same as the inside diameter 276 of the rear stage 344 of the housing 262. The outside diameter of the second stage 348 is less than the outside diameter of the first and third stages 346 and 350. The outside diameter 352 of the third stage 350 is smaller than the outside diameter of the first stage 346.

The third stage 350 of the outer surface 354 has an outside diameter 352. The outside diameter 352 of the third stage 350 is larger than the inside diameter 276 of the rear stage 344 of the housing 262. This larger outside diameter 352 prevents or impedes the shield 264 from being removed from the interior opening 336 of the housing 262 through the first opening 288.

In one embodiment, the shield 264 includes one or more indentations 278 between the first shoulder 272 and the second shoulder 274 of the housing 262. The indentations 278 engage the dielectric holder 242 and impede or prevent the separation of the dielectric holder 242 from the shield 264. The indentations 278 may be created by crimping the shield 264 prior to inserting the shield 264 into the housing 262, for example.

During assembly, the shield 264 is inserted into the interior opening 336 of the housing 262 through the first opening 288. The shield 264 is inserted into the interior opening 336 until the shield 264 contacts the second shoulder 274 of the housing 262. The second shoulder 274 engages the shield 264 between the first and second stages 346 and 348 of the shield 264. The second shoulder 274 prevents the shield 264 from being inserted into the interior opening 336 of the housing 104 past the second shoulder 274 and out of the second opening 268.

The second and third stages 348 and 350 of the shield 264 may have approximately the same outside diameter prior to inserting the shield 264 into the interior chamber 336. For example, the second and third stages 348 and 350 may have approximately the same outside diameter as the inside diameter 276 of the rear stage 344 of the housing 262. Once the shield 264 is inserted into the interior chamber 336 until the shield 264 contacts the second shoulder 274 of the housing 262, the outside diameter 352 of the third stage 350 may be increased. For example, the outside diameter 352 of the third stage 350 may be increased so that the outside diameter 352 is larger than the outside diameter of the second stage 348. The outside diameter 352 of the third stage 350 may be increased by inserting a tapered tube into the third stage 350.

In one embodiment, the third stage 350 of the shield 264 has an outside diameter that is at least 1 mil (or 0.0254 mm) larger than the outside diameter of the second stage 348 of the shield 264. In another embodiment, the third stage 350 of the shield 264 has an outside diameter that is at least 2 mils (or 0.0508 mm) larger than the outside diameter of the second stage 348 of the shield 264.

Figure 9:
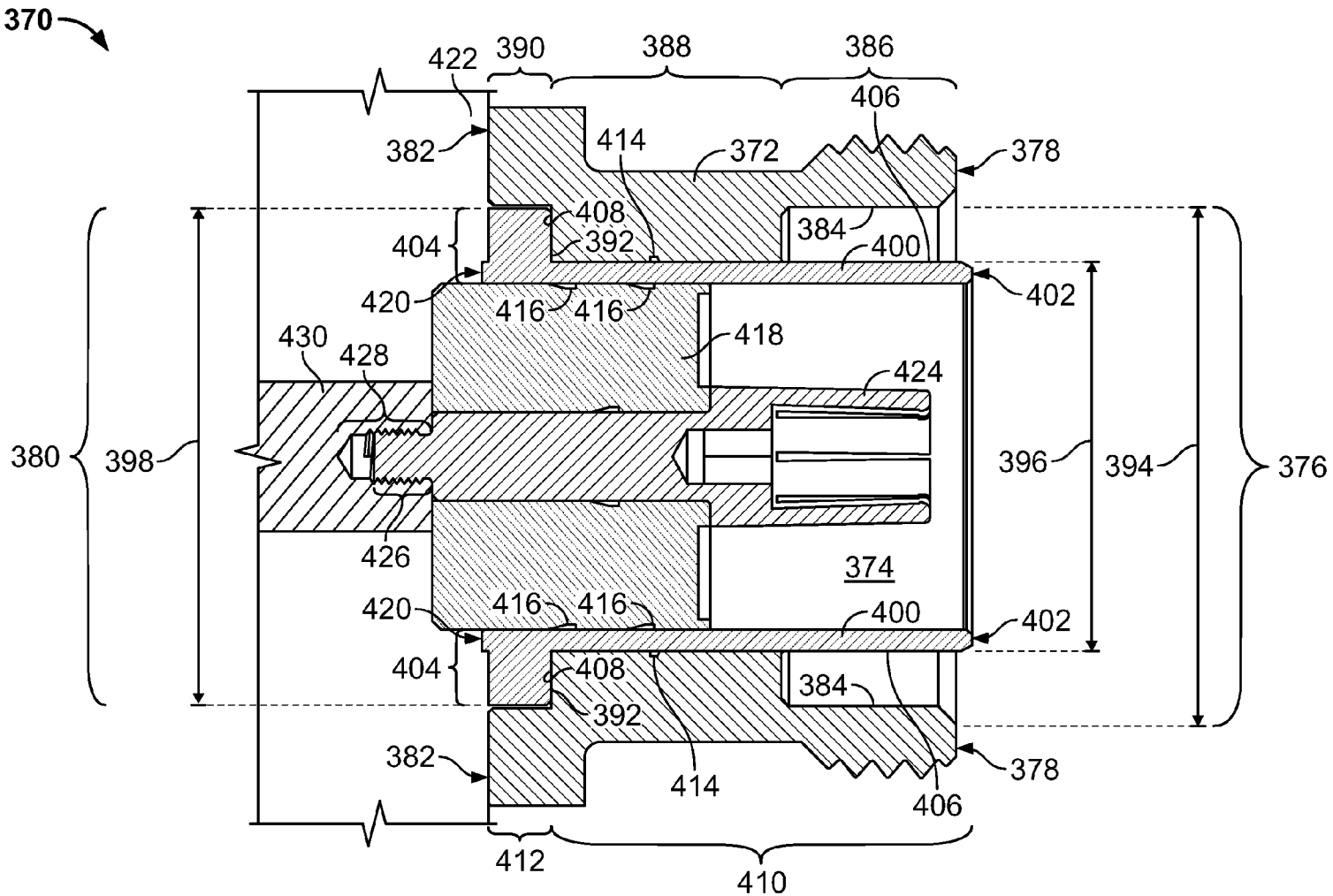
FIG. 9 is a cross-sectional view of another embodiment of a composite electrical connector assembly.

FIG. 9 is a cross-sectional view of another embodiment of a composite electrical connector assembly 370. The connector assembly 370 includes a housing 372 having an interior opening 374 with a first opening 376 at a mating end 378 and a second opening 380 at a mounting end 382. The interior opening 374 has a stepped cylindrical inner surface 384 that is staged in diameter to form a front stage 386, an intermediate stage 388 and a rear stage 390. The intermediate and rear stages 386, 388 are separated by a shoulder 392.

The interior opening 374 has a different inside diameter in two or more of the stages 386, 388, 390. The interior opening 374 has an inside diameter 394 in the front stage 386, an inside diameter 396 in the intermediate stage 388, and an inside diameter 398 in the rear stage 390. The inside diameter 394 of the front stage 386 and the inside diameter 380 of the rear stage 390 are greater than the inside diameter 396 of the intermediate stage 388.

The connector assembly 370 also includes a shield 400 disposed within the interior opening 374 of the housing 372. The shield 400 has a tubular elongated shape that extends between a connector interface end 402 and a terminating end 404. The terminating end 404 includes a contact ring 420 that protrudes from the terminating end 404. The contact ring 420 may extend into and make an electrical contact to a device panel 422 to which the connector assembly 370 is mounted.

The shield 400 has an outer surface 406 that is shaped to fit within the interior opening 374. The outer surface 406 is staged in diameter to form a front stage 410 and a rear stage 412. The rear stage 412 includes a flange 408. Each of the front and rear stages 410, 412 has a different outside diameter. The outside diameter of the front stage 410 is approximately the same as the inside diameter 396 of the intermediate stage 388 of the housing 372. The outside diameter of the rear stage 412 is approximately the same as the inside diameter 398 of the rear stage 390 of the housing 372.

In the illustrated embodiment, the shield 400 includes one or more housing barbs 414 and a plurality of dielectric barbs 416. The housing barb 414 extends radially outward from the outer surface 406 of the shield 400 into the inner surface 384 of the housing 372. The housing barb 414 impedes or prevents the shield 400 from being separated from the housing 372. The dielectric barbs 416 extend radially inward from the shield 400 into a dielectric holder 418. The dielectric barbs 416 impede or prevent the dielectric holder 418 from being separated from the shield 400. While the housing and dielectric barbs 414, 416 are illustrated in FIG. 9, these barbs 414, 416 may be used in other embodiments described herein.

In one embodiment, an electrical contact 424 is located in the interior opening 374 in the shield 400. The electrical contact 424 may include a threaded connection 426 at a terminating end 428. An electrical conductor 430 in the device panel 422 may be secured to the terminating end 428 by screwing the threaded connection 426 into the electrical conductor 430.

During assembly, the shield 400 is inserted into the interior opening 374 of the housing 372 through the second opening 380. The shield 400 is inserted into the interior opening 374 until the flange 408 of the shield 400 engages the shoulder 392 of the housing 372. The shoulder 392 engages the flange 408 and prevents the flange 408 from being inserted into the interior opening 374 past the shoulder 392. Thus, the shield 400 is inserted into the interior opening 374 through the second opening 380 but is prevented from exiting the housing 372 through the first opening 376 by the shoulder 392.

Figure 10:
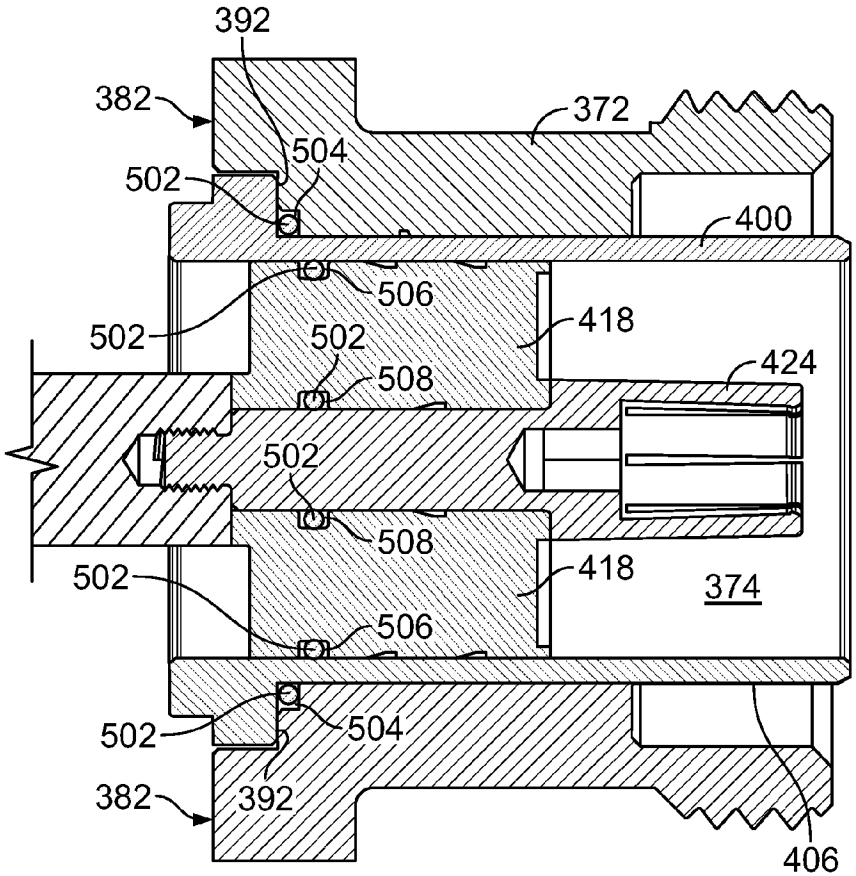
FIG. 10 is a cross-sectional view of another embodiment of a composite connector assembly.

FIG. 10 is a cross-sectional view of another embodiment of a composite connector assembly 500. The connector assembly 500 is similar to the connector assembly 370 of FIG. 9. The connector assembly 500 includes a plurality of seals 502 located in a plurality of gaps 504, 506, 508. The seals 502 may comprise an o-ring formed of a resilient material. A first gap 504 is provided between the shield 400 and the housing 372 in a location that is proximate to the mounting end 382 of the housing 372. The first gap 504 may be formed by removing a portion of the housing 372 in a location that is proximate to the shoulder 392.

A second gap 506 is provided between the shield 400 and the dielectric holder 418. The second gap 506 may be formed by removing a portion of the dielectric holder 418.

A third gap 508 is provided between the dielectric holder 418 and the electrical contact 424. The third gap 508 also may be formed by removing a portion of the dielectric holder 418.

The seals 502 may impede the intrusion of fluids into the interior opening 374 of the connector assembly 350. For example, the seals 502 may help prevent water from reaching the interior opening 374 from the mounting end 382 of the housing 372. Alternatively, a sealing adhesive is used in place of the seals 502. For example, a sealing adhesive can be provided between the housing 372 and the shield 400, between the shield 400 and the dielectric holder 418, and/or between the dielectric holder 418 and the electrical contact 424.

The seals 502 may be used in other embodiments described herein. For example, gaps such as the first, second and third gaps 504, 506, 508 may be provided between the shields and housings, between the shields and dielectric holders and/or between the dielectric holders and electrical contacts in one or more of the other embodiments described herein. For example, with respect to the connector assembly 102 of FIG. 4, a gap 504 and/or seal 502 may be provided between the housing 504 and the shield 106 in a location that is proximate to the second shoulder 138 of the housing 504. With respect to the connector assembly 160 of FIG. 5, a gap 504 and/or seal 502 may be provided between the housing 162 and the shield 164 in a location that is proximate to the shoulder 172 of the housing 162. With respect to the connector assembly 200 of FIG. 6, a seal 502 may be provided in the gap 215. With respect to the connector assembly 200 of FIG. 7, a seal 502 may be provided in the gap 217. With respect to the connector assembly 260 of FIG. 8, one or more seals 502 may be located in gaps (not shown) that are provided in locations proximate to the first and/or second bends 275, 277 in the shield 264. However, other locations for the seals 502 may be provided in accordance with the embodiments described herein.

Figure 11:
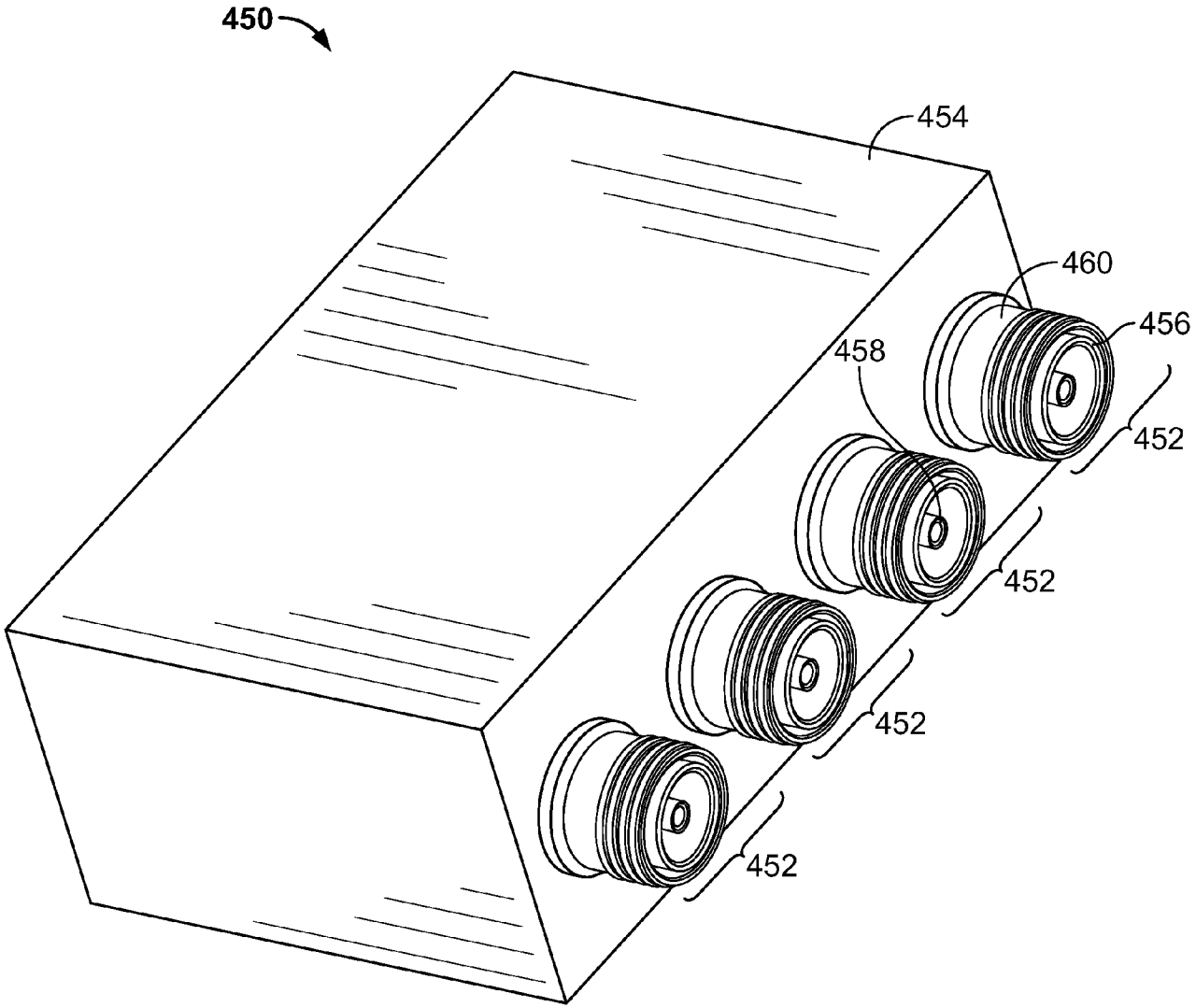
FIG. 11 is a perspective view of a multiple position connector assembly according to one embodiment.

FIG. 11 is a perspective view of a multiple position connector assembly 450 according to one embodiment. The multiple position connector assembly 450 includes a plurality of composite connector assemblies 452 that protrude from a device housing 454. The connector assemblies 452 may include one or more of the embodiments of the connector assemblies described herein. Each of the connector assemblies 452 includes a housing 460, a shield 456 and an electrical contact 458. The housing 460, shield 456 and electrical contact 458 may be similar to or the same as any of the embodiments described herein.

The housing 460 of the connector assemblies 452 may be integrally formed with the device housing 454. The device housing 454 may include or be formed of a conductive material. For example, the device housing 454 may be formed from a zinc die east material or aluminum. Alternatively, the device housing 454 may be formed from a nonconductive material with a conductive surface. For example, the device housing 454 may be formed from a nonconductive material that is coated with a plated metal surface using an MID process.

The device housing 454 may hold a computing device (not shown) that receives electrical connectors (not shown) at each of the connector assemblies 452. For example, the device housing 454 may hold a filter or an amplifier.

Figure 12:
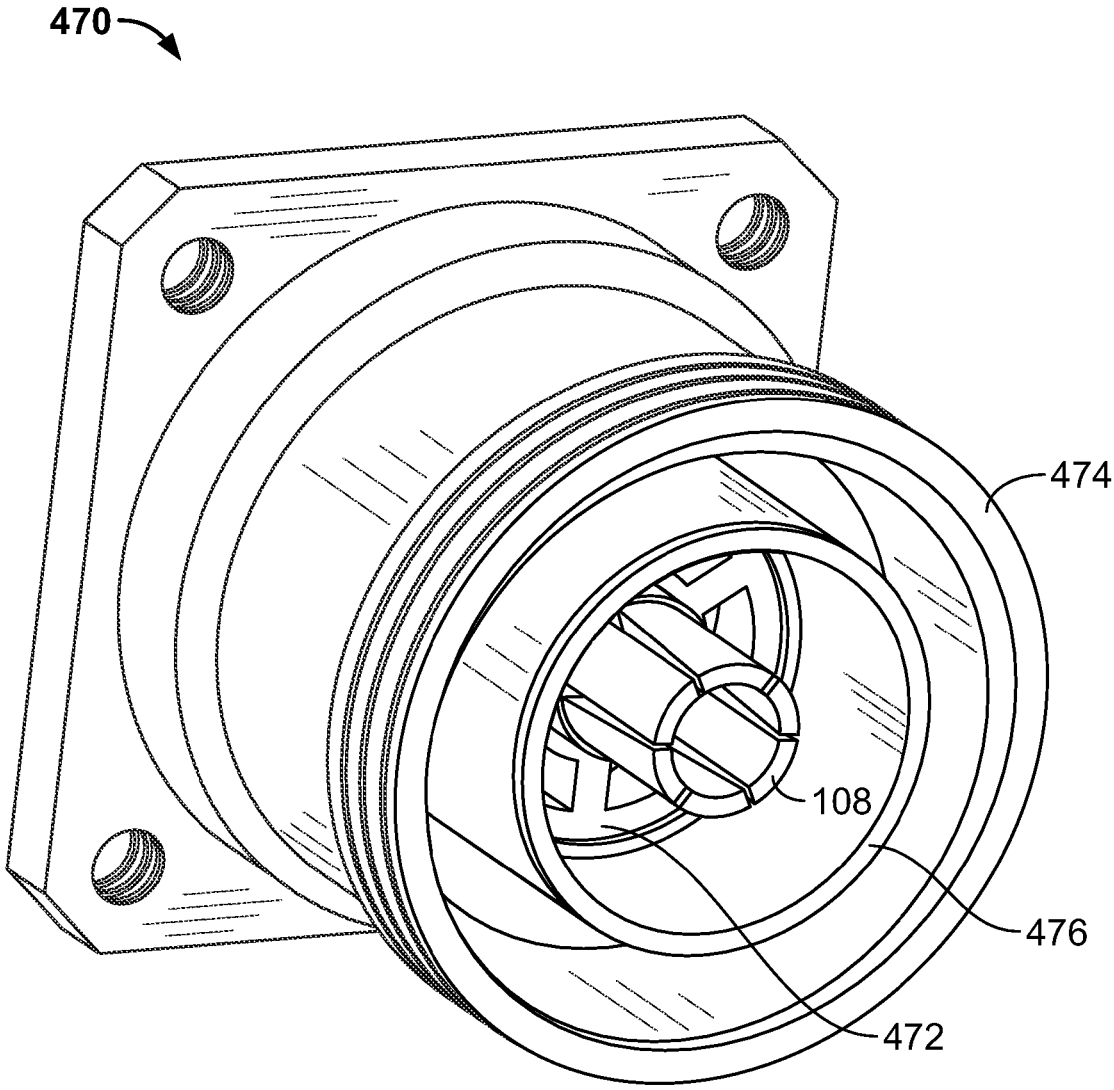
FIG. 12 is a perspective view of a connector assembly having another embodiment of a dielectric holder.

FIG. 12 is a perspective view of a connector assembly 470 having another embodiment of a dielectric holder 472. The connector assembly 470 may be similar to the various embodiments of the connector assemblies described above and illustrated in FIGS. 1 through 11. For example, the connector assembly 470 includes a housing 474 with a shield 476 located within an interior chamber (not shown) of the housing 474. The electrical contact 108 is located within the shield 476 and is at least partially surrounded by the dielectric holder 472.

In one embodiment, the dielectric holder 472 is formed of an injection molded polymer. For example, the dielectric holder 472 may be formed of a plastic material using an injection molding process. The cost of producing the dielectric holder 472 may be reduced by using an injection molding process to manufacture the dielectric holder 472.

Figure 13:
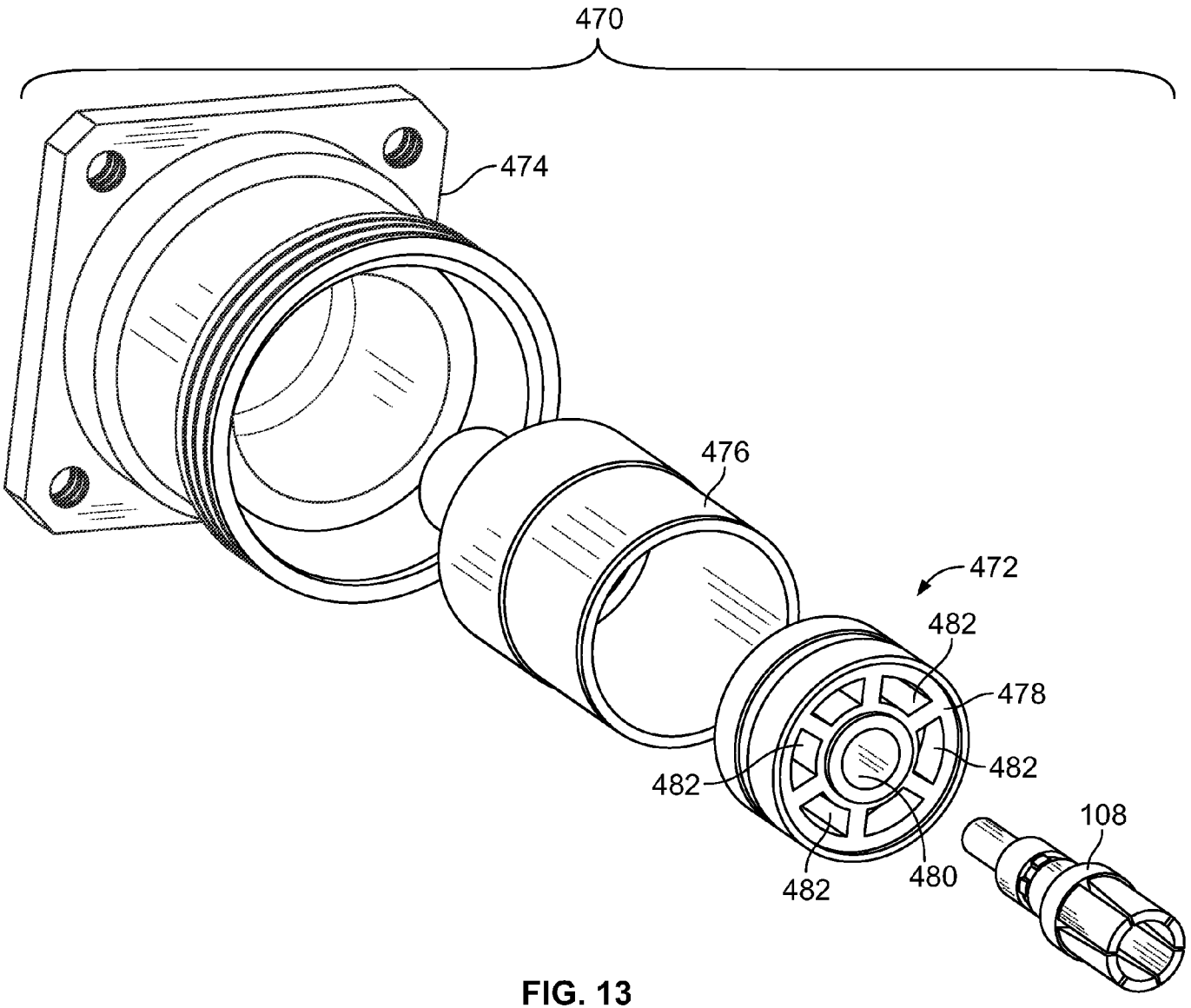
FIG. 13 is an exploded view of the connector assembly shown in FIG. 12.

FIG. 13 is an exploded view of the connector assembly 470. As shown in FIG. 13, the dielectric holder 472 includes a body 478. The body 478 is shaped to fit within the shield 476. The body 478 includes a center hole 480. The electrical contact 108 is inserted into the center hole 480 so that the body 478 at least partially surrounds the electrical contact 108. The body 478 also includes one or more voids 482. The voids 482 are openings or air pockets in the body 478. In the illustrated embodiment, the body 478 includes six voids 482. The voids 482 may extend all the way through the body 478. Alternatively, the voids 482 may extend only partially through the body 478.

The voids 482 are provided in the body 478 in order to increase the impedance of the dielectric holder 472. As described above, the body 478 may be formed from a polymer through an injection molding process. The impedance of polymers used in injection molding processes may be lower than the materials used in other dielectric holders. For example, the impedance of the materials used to create the dielectric holder 472 may be lower than the impedance of the fluorinated polymers that may be used to create the dielectric holder 242 (shown in FIG. 3). The air pockets existing in the voids 482 increase the impedance of the dielectric holder 472. In one embodiment, the number and/or size of the voids 482 are increased until the impedance of the dielectric holder 472 approaches or is approximately the same as a dielectric holder that is not formed from an injection molded process. For example, the number and/or size of the voids 482 may be increased until the impedance of the dielectric holder 472 is approximately the same as the impedance of a dielectric holder formed from a fluorinated polymer.

While FIGS. 1 through 13 illustrate a 7/16 DIN RF connector, the connector assemblies described herein can be used with a variety of electrical connectors. For example, the connector assembly 102 can be used as a bayonet Neill-Concelman ("BNC"), connector, a C connector, a Dezifix connector, a GR connector, an F connector, an HN connector, a Belling-Lee connector or IEC 169-2 connector, an LC connector, an N connector, an SC RF connector, a threaded Neill-Concelman ("TNC") connector, or a UHF connector, for example. The 7/16 DIN RF connector illustrated in FIGS. 1 through 13 is thus merely illustrative and not restrictive.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A composite electrical connector assembly comprising:

a housing formed from a first material and having an interior chamber comprising a stepped cylindrical inner surface with a first opening at a mating end of the housing and a second opening at a mounting end of the housing, the interior chamber being staged in diameter to form front, intermediate and rear stages with a forward shoulder between the front and intermediate stages and a rear shoulder between the intermediate and rear stages;

a shield formed from a second material and shaped to fit within the interior chamber, the shield prevented from being removed from the second opening by abutting the inner surface of the housing in the front stage and the forward shoulder at the same time and abutting the inner surface of the housing in the rear stage and the rear shoulder at the same time; and an electrical contact disposed within the interior chamber and aligned along a longitudinal axis of the connector assembly, the electrical contact having first and second ends, the first end being configured to receive a center conductor of a cable, the second end being configured to connect with a conductor of a device.

2. The connector assembly according to claim 1, wherein the first material is a nonconductive material and the second material is a conductive material.

3. The connector assembly according to claim 1, wherein the shield extends between a terminating end and a connector interface end, the shield being staged in diameter to form first, second and third stages, the first and second stages disposed within the interior chamber of the housing, the third stage extending between the terminating end and the mounting end of the housing and protruding from the housing through the second opening in the mounting end of the housing.

4. The connector assembly according to claim 1, wherein the shield comprises a radially protruding flange that engages the forward shoulder and the inner surface of the housing in the front stage of the housing at the same time and the shield includes a shoulder that engages the rear shoulder of the housing and the inner surface of the housing in the rear stage of the housing at the same time.

5. The connector assembly according to claim 1, wherein the intermediate stage extends from the forward shoulder to the rear shoulder.

6. The connector assembly according to claim 1, wherein the shield engages the inner surface of the housing only in the front and rear stages of the housing and at the forward and rear shoulders.

7. The connector assembly according to claim 1, wherein the inner surface of the housing in the front stage intersects the forward shoulder and the inner surface of the housing in the intermediate stage intersects the rear shoulder.

8. The connector assembly according to claim 1, wherein the inner surface of the housing in the intermediate stage intersects both the forward shoulder and the rear shoulder of the housing.

9. An electrical connector assembly comprising:

a housing having an interior chamber comprising an inner surface, the inner surface having first and second openings at opposing sides of the housing, the interior chamber being staged in diameter to form front, intermediate and rear stages with a forward shoulder between the front and intermediate stages and a rear shoulder between the intermediate and rear stages, the inner surface of the front stage intersecting the forward shoulder, the inner surface of the rear stage intersecting the rear shoulder;

a shield shaped to fit within the interior chamber, the shield engaging the inner surface of the housing in the front stage and the forward shoulder at the same time and the inner surface of the housing in the rear stage and the rear shoulder at the same time; and an electrical contact disposed within the interior chamber and aligned along a longitudinal axis of the connector assembly, the electrical contact having first and second ends, the first end being configured to receive a center conductor of a cable, the second end being configured to connect with a conductor of a device.

10. The connector assembly according to claim 9, wherein the housing is formed from a nonconductive material.

11. The connector assembly according to claim 9, wherein the intermediate stage extends from the forward shoulder to the rear shoulder.

12. The connector assembly according to claim 9, wherein the shield engages the inner surface of the housing only in the front and rear stages of the housing and at the forward and rear shoulders.

13. The connector assembly according to claim 9, wherein the inner surface of the housing in the intermediate stage intersects both the forward shoulder and the rear shoulder of the housing.

14. A composite electrical connector assembly comprising:

a housing formed from a first material and comprising a mating end, a mounting end, and an interior chamber, the interior chamber comprising an inner surface with a first opening at the mating end and a second opening at the mounting end, the interior chamber having a plurality of inside diameters forming front, intermediate, and rear stages with a forward shoulder between the front and intermediate stages and a rear shoulder between the intermediate and rear stages;

a shield formed from a second material and shaped to fit within the interior chamber, the shield having an outside surface that simultaneously engages the forward shoulder and the inner surface of the housing in the front stage and simultaneously engages the rear shoulder and the inner surface of the housing in the rear stage, at least a portion of the outside surface having an outside diameter that is larger than at least one of the inside diameters of the interior chamber;

an electrical contact disposed within the interior chamber and configured to receive a center conductor of a cable; and a dielectric holder disposed between the electric contact and the shield, the dielectric holder electrically isolating the electrical contact from the shield.

15. The connector assembly according to claim 14, wherein the first material is a nonconductive material and the second material is a conductive material.

16. The connector assembly according to claim 14, wherein an engagement between the inner surface and the portion of the outside surface of the shield that has the larger outside diameter than at least one of the inside diameters of the inner surface prevents the shield from being removed from the interior chamber through at least one of the first and second openings.

17. The connector assembly according to claim 14, wherein the intermediate stage extends from the forward shoulder to the rear shoulder.

18. The connector assembly according to claim 14, wherein the shield engages the inner surface of the housing only in the front and rear stages of the housing and at the forward and rear shoulders.

19. The connector assembly according to claim 14, wherein the inner surface of the housing in the front stage intersects the forward shoulder and the inner surface of the housing in the intermediate stage intersects the rear shoulder.

20. The connector assembly according to claim 14, wherein the inner surface of the housing in the intermediate stage intersects both the forward shoulder and the rear shoulder of the housing.

* * * * *